US007134979B2

(12) United States Patent
Edwards

(10) Patent No.: US 7,134,979 B2
(45) Date of Patent: Nov. 14, 2006

(54) HOCKEY PUCK

(75) Inventor: Donald V. Edwards, Harrison City, PA (US)

(73) Assignee: Simtec, Co., Irwin, PA (US)

( * ) Notice: Subject to any disclaimer, the term of this patent is extended or adjusted under 35 U.S.C. 154(b) by 147 days.

(21) Appl. No.: 10/788,087

(22) Filed: Feb. 26, 2004

(65) Prior Publication Data

US 2005/0192130 A1 Sep. 1, 2005

(51) Int. Cl.
*A63B 71/00* (2006.01)

(52) U.S. Cl. ..... 473/588

(58) Field of Classification Search ..... 473/588, 473/589

See application file for complete search history.

(56) References Cited

U.S. PATENT DOCUMENTS

| | | | | |
|---|---|---|---|---|
| 2,494,929 | A | 1/1950 | Colaluca | |
| 2,634,982 | A | 4/1953 | Gaede | |
| 4,078,801 | A | 3/1978 | White, Sr. | |
| 4,153,253 | A | 5/1979 | White, Sr. | |
| 5,014,990 | A | 5/1991 | Kaser et al. | |
| 5,240,251 | A | 8/1993 | Filice | |
| 5,269,520 | A * | 12/1993 | Vellines | 473/588 |
| 5,792,012 | A | 8/1998 | Dudley | |
| 5,816,964 | A | 10/1998 | Ainslie et al. | |
| 5,976,042 | A | 11/1999 | LaMarche et al. | |
| 6,126,561 | A * | 10/2000 | Mark | 473/588 |
| 6,638,188 | B1 * | 10/2003 | Hartman et al. | 473/588 |
| 6,746,350 | B1 * | 6/2004 | Hartman et al. | 473/588 |
| 2005/0192130 | A1 * | 9/2005 | Edwards | 473/588 |

* cited by examiner

*Primary Examiner*—Raleigh W. Chiu
(74) *Attorney, Agent, or Firm*—James Ray & Assoc.

(57) ABSTRACT

A hockey puck comprising a resilient material having a first configuration, a first thickness and a predetermined hardness. There is a first disk having a second configuration and a second thickness that is engageable with a first side of the resilient material and a second disk having a third configuration and a third thickness engageable with a radially opposed second side of the resilient material. Both disks are produced from a preselected material having a predetermined coefficient of friction. The resilient material extends beyond a periphery of the first disk and the second disk a predetermined distance. The second thickness and the third thickness of the first disk and the second disk, respectively, each have a thickness which is at least as thick as one half of the thickness of the resilient material. There is, further, a first means for securing the first disk to at least one of the second disk and the resilient material adjacent the first side of the resilient material and a second means for securing the second disk to at least one of the first disk and the resilient material adjacent the radially opposed second side of the resilient material.

12 Claims, 6 Drawing Sheets

HOCKEY PUCK

FIELD OF THE INVENTION

The present invention relates to a hockey puck, and, more particularly, the present invention relates to a hockey puck that can be used on surfaces such as carpeted floors, grass and ice without damaging any surface which it might contact.

BACKGROUND OF THE INVENTION

A wide variety of hockey pucks have been developed for use on a variety of surfaces. One criteria for a hockey puck is that it should travel on whatever surface it is on without tumbling, bouncing or being slowed because of uneven contact with that surface. The most common hockey puck, obviously, is a puck that is made for use on ice surfaces. Since ice surfaces tend to be free of snags the likelihood of bouncing is minimal.

However, other pucks have been developed that are designed for use on unsmooth surfaces such as streets and parking lots. These have been developed so that they can travel over these rough or uneven surfaces with a greatly reduced likelihood of tumbling or bouncing. Some of these pucks have bristles on the outer surfaces of the puck while other have springs disposed between the outer surfaces to reduce the problem of bouncing or flipping when the puck strikes a imperfection.

SUMMARY OF THE INVENTION

The present invention provides a hockey puck comprising a resilient material having a first predetermined configuration, a first predetermined thickness, and a predetermined hardness. There is a first disk having a second predetermined configuration and a second predetermined thickness that is engageable with a first side of the resilient material. The first disk is produced from a preselected material having a predetermined coefficient of friction. A second disk has a third predetermined configuration and a third predetermined thickness and is engageable with a radially opposed second side of the resilient material. The second disk is produced from the preselected material and has the same predetermined coefficient of friction. The resilient material extends beyond a periphery of the first disk and the second disk a predetermined distance. The second predetermined thickness and the third predetermined thickness of the first disk and the second disk, respectively, each have a thickness which is at least as thick as one half of the first predetermined thickness of the resilient material. There is, further, a first means for securing the first disk to at least one of the second disk and the resilient material adjacent the first side of the resilient material and a second means for securing the second disk to at least one of the first disk and the resilient material adjacent the radially opposed second side of the resilient material.

An alternate embodiment of the invention provides a blow molded one piece hockey puck comprising a central portion having a first predetermined configuration and a first predetermined width. There is a first sliding surface extending outwardly from a first surface of the central portion having a second predetermined configuration and a second predetermined width. There is a radially opposed second sliding surface that extends outwardly from a radially opposed second surface of the central portion having a third predetermined configuration and a third predetermined width. The central portion extends beyond a periphery of the first sliding surface and the second sliding surface a predetermined distance. The second predetermined width and the third predetermined width of the first sliding surface and the second sliding surface, respectively, each have a width which is at least as thick as one half of the first predetermined width of the central portion.

OBJECTS OF THE INVENTION

It is, therefore, one of the primary objects of the present invention to provide a hockey puck which is primarily adapted for use on a carpeted surface.

Another object of the present invention is to provide a hockey puck for use on a carpeted surface which will not mar surfaces that it contacts.

Yet, another object of the present invention is to provide a hockey puck for indoor use which will lessen the possibility of injury to a player if struck by the puck.

Still, another object of the present invention is to provide a hockey puck for indoor use which will not trip, bounce, or flip when it slides across the carpet.

It is another object of the present invention to provide a hockey puck for indoor use which is relatively inexpensive to manufacture.

Another object of the present invention is to provide a hockey puck which is blow molded.

Still, another object of the present invention is to provide a hockey puck which is one piece.

In addition to the numerous objects and advantages of the present invention which have been described with some degree of particularity above, it should be both noted and understood that a number of other important objects and advantages of the invention will become more readily apparent to those persons who are skilled in the relevant art from the following more detailed description of the invention, particularly, when such detailed description is taken in conjunction with the appended claims.

Figure 1:
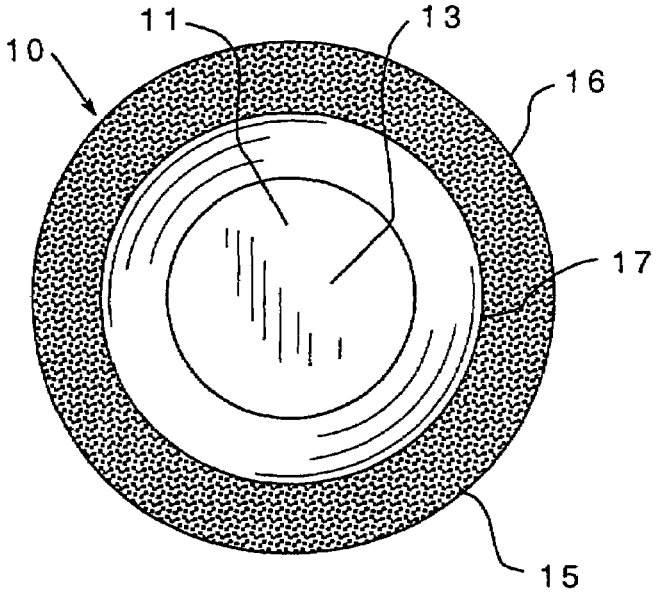
FIG. 1 is a plan view of the hockey puck of the present invention according to one embodiment.

BRIEF DESCRIPTION OF THE PRESENTLY PREFERRED AND VARIOUS ALTERNATE EMBODIMENTS OF THE PRESENT INVENTION

Prior to proceeding to the more detailed description of the present invention, it should be noted that for the sake of clarity in understanding the invention, identical components with identical functions have been designated with identical reference numerals throughout the drawing Figures.

Figure 2:
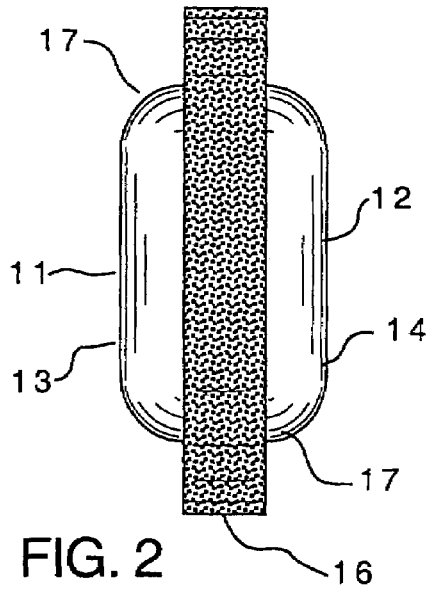
FIG. 2 is a side elevation view of the hockey puck shown in FIG. 1.
Figure 3:
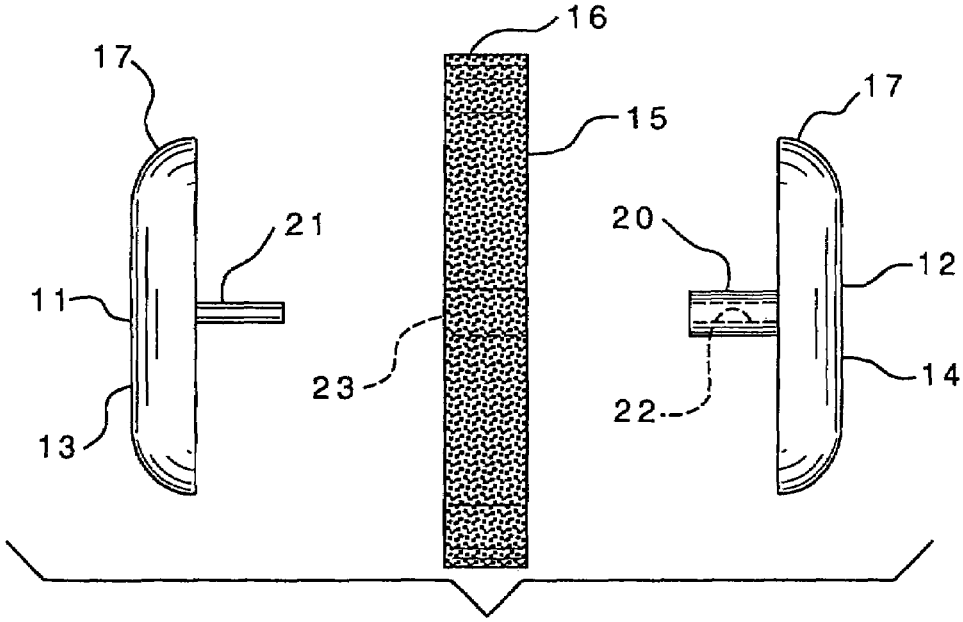
FIG. 3 is an exploded view in side elevation of the hockey puck shown in FIGS. 1 and 2 illustrating the parts for assembly of such hockey puck.

Illustrated in FIGS. 1, 2 and 3, is a hockey puck, generally designated 10, according to one embodiment of the present invention. The hockey puck 10 includes first and second disks 11 and 12, respectively. Such first and second disks 11, 12 have outer relatively flat surfaces 13 and 14 for sliding upon a carpeted surface. A resilient elastomeric material 15 in the shape of a disk is sandwiched between such first and second disks 13 and 14 with perimetrical edges 16 of the resilient elastomeric material 15 thereof extending beyond the perimetrical edges 17 of disks 13 and 14 for resilient engagement with objects such as walls.

It is very important to note that the thickness of the first and second disks 11 and 12 is greater than half the thickness of resilient elastomeric material 15. A hockey puck typically slides at a slight angle from the horizontal and this feature prevents the protruding perimetrical edges 16 of resilient material 15 from catching or engaging the carpet surface and thereby prevents the puck 10 from flipping. It is preferred that such resilient material have a thickness of between about 0.388 and about 0.488 inches. In the most presently preferred embodiment of the invention such thickness of such resilient material 15 is 0.4375 inches (≈7/16 inches). Also it is preferred that such first disk 11 and such second disk 12 have substantially identical thicknesses and that such thickness is between about 0.265 and about 0.365 inches (≈5/16 inches).

As is evident in the drawing Figures such perimetrical edges 17 of the first disk 11 and second disk 12 have an arcuate shape. The arcuate shape extends from the surface of such disks 11, 12 that engages such resilient material 15 to the bottom sliding surface of disks 11 and 12. This arcuate shape prevents the hockey puck 10 from catching or engaging the carpet surface or other imperfections on the engageable surface, whether it is carpet or otherwise, so as to permit the hockey puck to glide freely.

Further, it is preferred that such perimetrical edge 16 of such resilient material 15 extend beyond the perimetrical edges 17 of such first disk 11 and such second disk 12 for a distance of between about 0.325 and about 0.425 inches. In the presently preferred embodiment of the invention such distance is about 0.375 inches (≈3/8 inches).

The first and second bottom disks 11 and 12 are solid and have a substantially equal circular diameter. It is presently preferred that these disks are molded from a plastic, such as tetrafluoroethylene, as manufactured under the trademark Teflon. However, it is within the scope of the invention that other smooth plastic materials with low coefficients of friction might also be used to form the discs 11 and 12.

Illustrated in FIG. 3 are the parts for assembly of such hockey puck 10 according to one embodiment of the invention. The disks 11 and 12 are secured together through a central connecting shaft, which includes a female socket shaft centrally secured to the inside of disk 12 and internal male shaft 21 which extends internally from disk 11. Male shaft 21 is sized to fit within the central opening 22 of female shaft 20 and it is there glued so that the pieces cannot be separated. Alternative connections may be provided such as a socket snap fit. It is also within the scope of the invention that such connection includes both a snap fit and an adhesive.

A sized central opening or passage 23 is provided centrally through resilient material 15 for passage of shaft 20. The resilient material 15 may be plastic or rubber. It is presently preferred that resilient material 15 be an elastomeric material which would typically be an elastomeric foam material that is readily available on the market. It should be a foam material which is resilient yet has memory and springs back to its original configuration.

Figure 6:
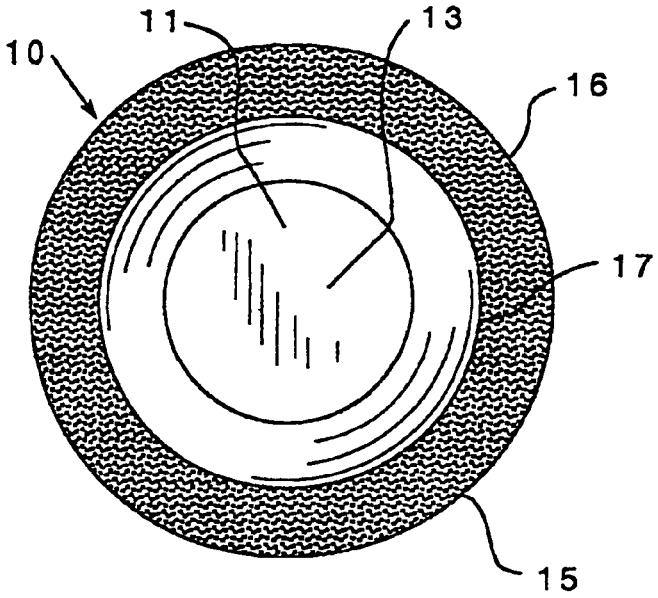
FIG. 6 is a plan view of the hockey puck of the present invention according to one embodiment.
Figure 7:
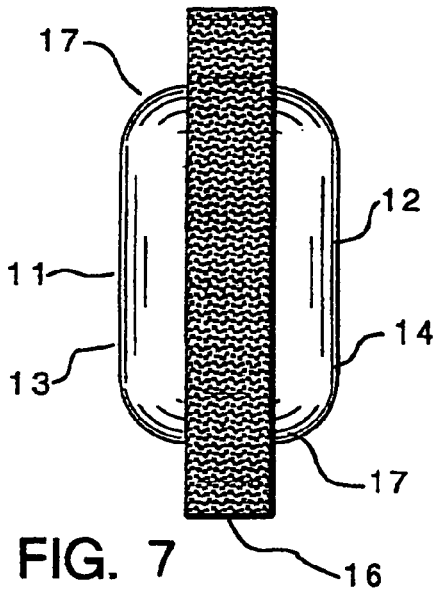
FIG. 7 is a side elevation view of the hockey puck shown in FIG. 6.
Figure 8:
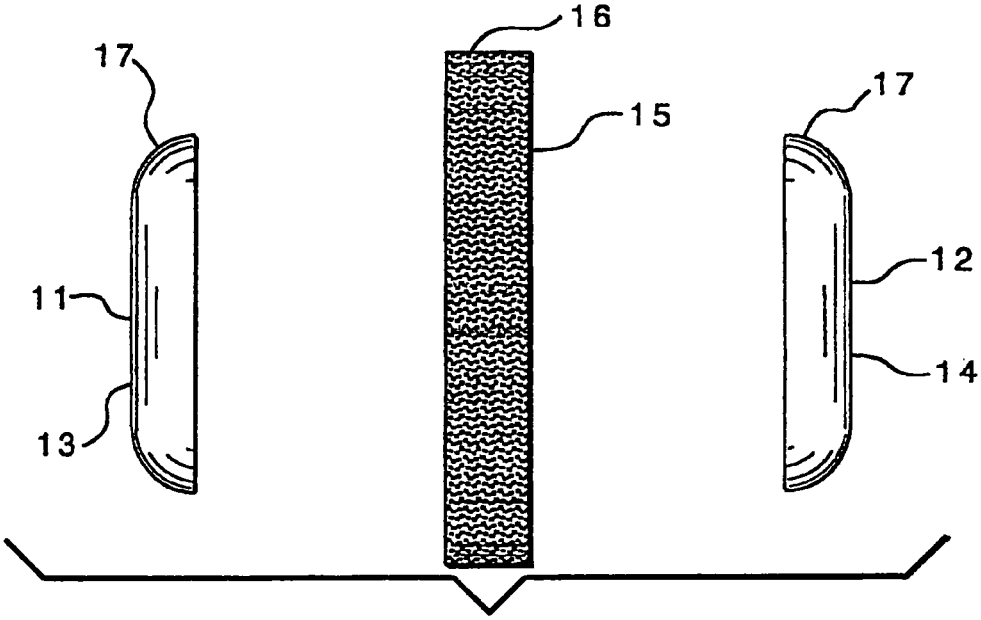
FIG. 8 is an exploded view in side elevation of the hockey puck shown in FIGS. 1 and 2 illustrating the parts of such hockey puck.

Illustrated in FIGS. 6, 7 and 8 is another embodiment of the invention. This embodiment is similar to that described above except in this embodiment first disk 11 and second disk 12 are bonded directly to such resilient material 15. The dimensions of the disks 11, 12 and the resilient material 15 in this embodiment are similar to those discussed previously. Further, the disks 11, 12 also have the same arcuate shape as discussed previously. It is presently preferred that such bonding of such disks 11,12 to the resilient material 15 is by means of an adhesive.

Figure 4:
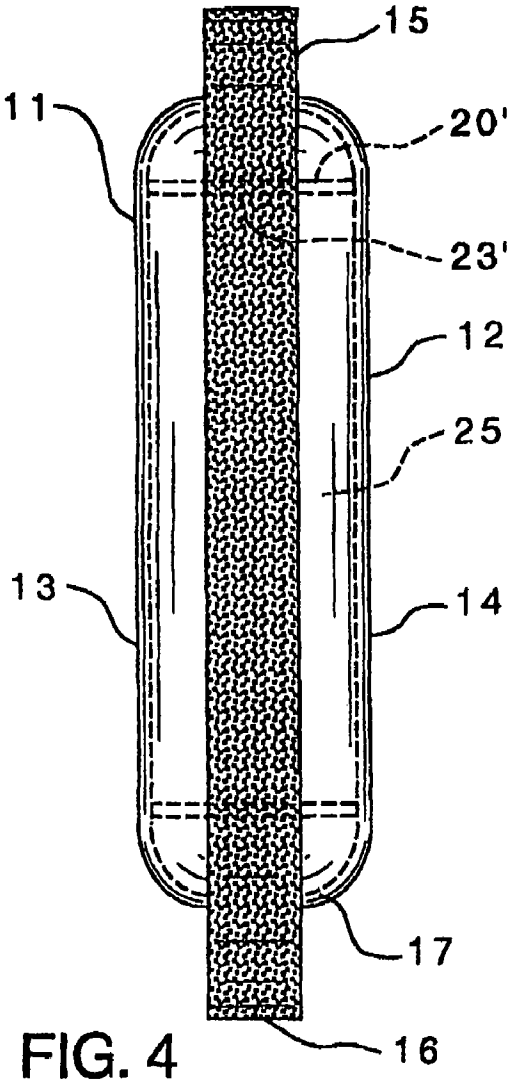
FIG. 4 is a side elevation view illustrating another embodiment of the hockey puck of the present invention.

A variation of the hockey puck 10 of the present invention is presented in FIG. 4. Similar parts are identified with the same or similar reference numerals. In this embodiment, disks 11 and 12 are made of the same plastic as before but in this embodiment are hollow or have hollow interiors and they are glued together or connected through a circular cylindrical member 20' which has a hollow interior that is filled with a weight in the form of a cylindrical mass of gel 25. In this embodiment, similar to the previous embodiment, the central shaft member or connecting cylinder 20' passes through a larger central opening in resilient member 15 as indicated at 23'.

Figure 5:
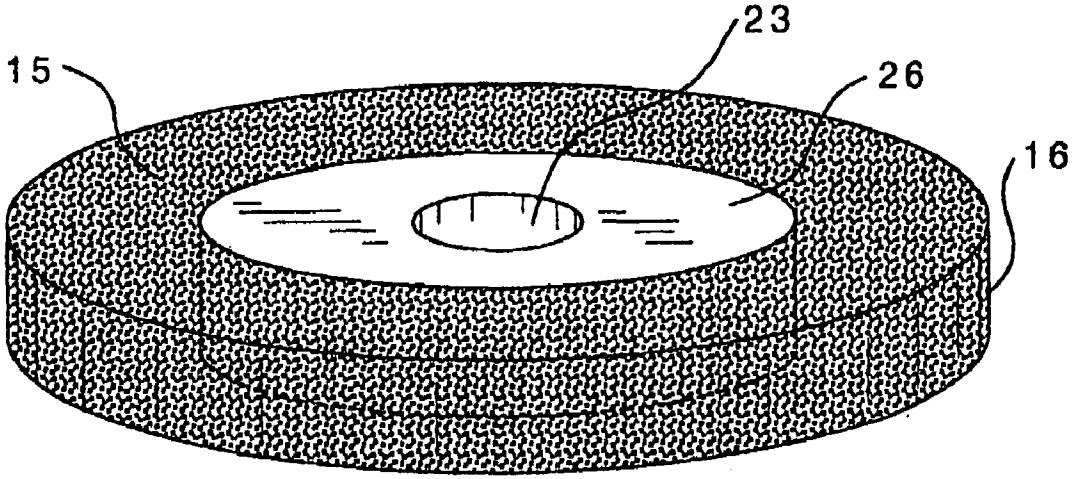
FIG. 5 is a perspective view of another embodiment of the center resilient foam core disk portion of the puck with a weighted core.

Referring next to the embodiment shown in FIG. 5, illustrated therein is the central resilient disk 15 for the hockey puck 10 of the embodiment shown in FIGS. 1 through 3, with some modifications. In this modification, the central portion of the resilient disk 15 is cutout and receives cylindrical lead weight 26 therein in order to add weight to the puck when and as desired when manufacturing the hockey puck. The lead weight 26 is provided again with the central opening or passage therethrough 23 for receiving shaft 20.

Because the puck has elastomeric resilient material on the exposed perimetrical edges, it will not mar surfaces it engages and there is considerably less likelihood that it will injure players if they are struck by the hockey puck 10. The hockey puck 10, further, has the ability of transmitting or transferring spin or "English" when the hockey puck 10 engages a wall which can be helpful when applying bank shots and presents an interesting ramification when bouncing the puck 10 of a wall.

Figure 9:
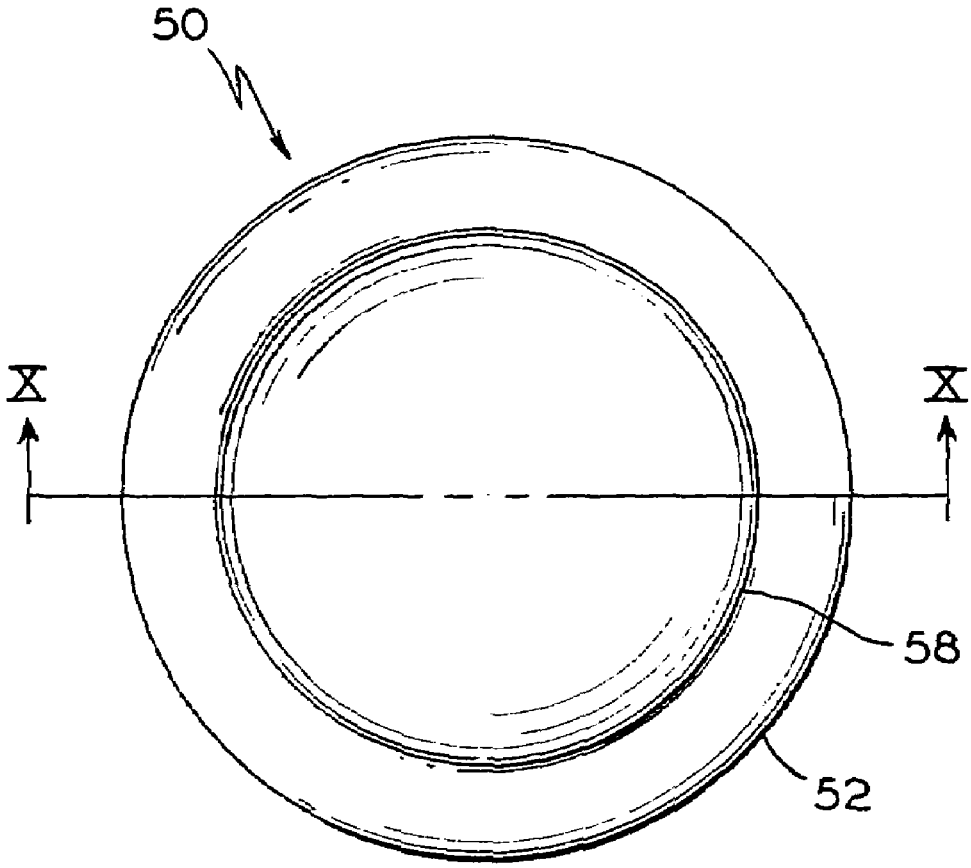
FIG. 9 is a plan view of a blow molded hockey puck of the present invention according to another embodiment.
Figure 10:
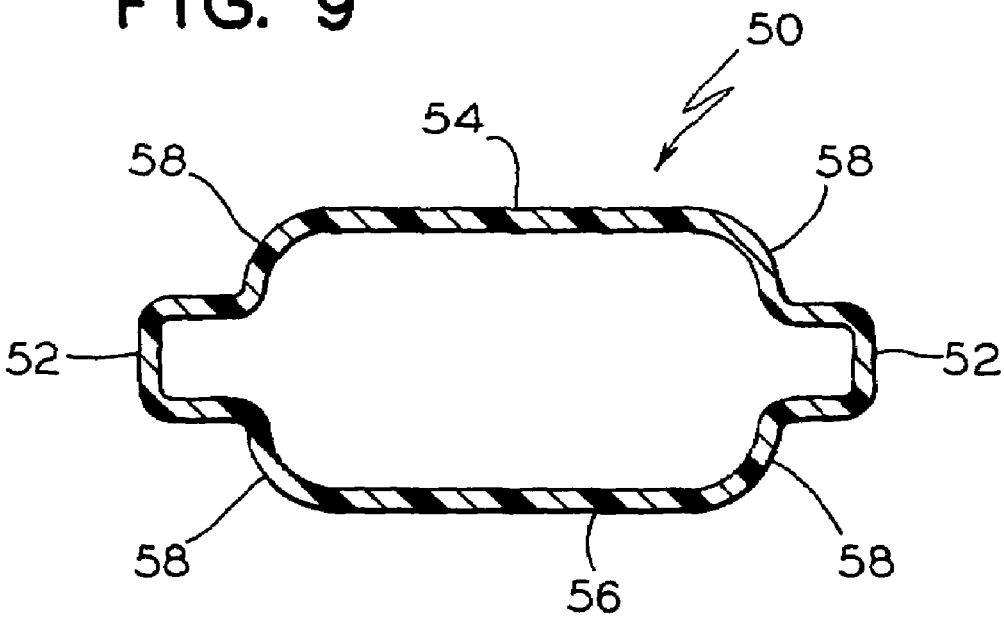
FIG. 10 is a cross sectional view of the blow molded hockey puck shown in FIG. 9 taken across the line X—X.

Illustrated in FIGS. 9 and 10 is still another embodiment of the invention. The hockey puck, generally designated 50, is blow molded as a one piece unit. In this embodiment the hockey puck 50 comprises a central portion 52 having a first predetermined diameter and a first predetermined width. There is a first sliding surface 54 having a second predetermined diameter and a second predetermined width and a second sliding surface 56 having a third predetermined diameter and a third predetermined width. The central portion 52 extends beyond a periphery 58 of the first and second sliding surfaces a predetermined distance. The second predetermined width and the third predetermined width of the first sliding surface 54 and the second sliding surface 56, respectively, each have a width which is at least as thick as one half of the width of said central portion 52. The dimensions and the shape of the central portion 52, the first sliding surface 54 and the second sliding surface 56 according to this embodiment are substantially the same as those discussed previously with the other embodiments. As is evident in FIG. 10 such blow molded one piece hockey puck 50 is substantially hollow. The plastic material used for the blow molded hockey puck has a degree of give to it so that it will not be dangerous if it strikes an individual.

Figure 11:
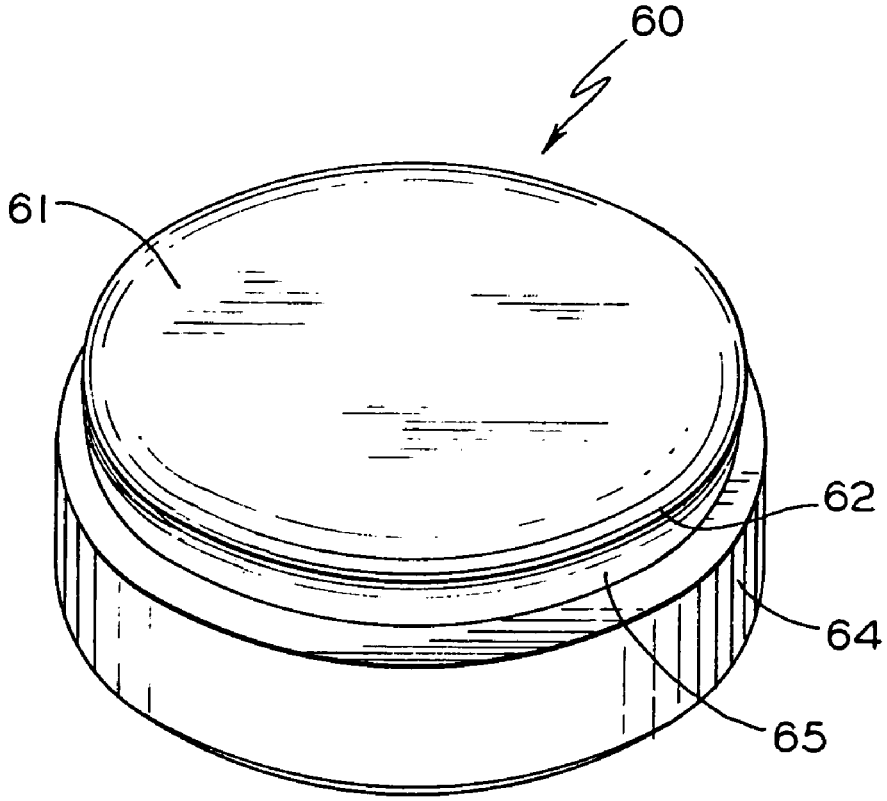
FIG. 11 is a perspective view of a blow molded hockey puck according to an alternate embodiment.
Figure 12:
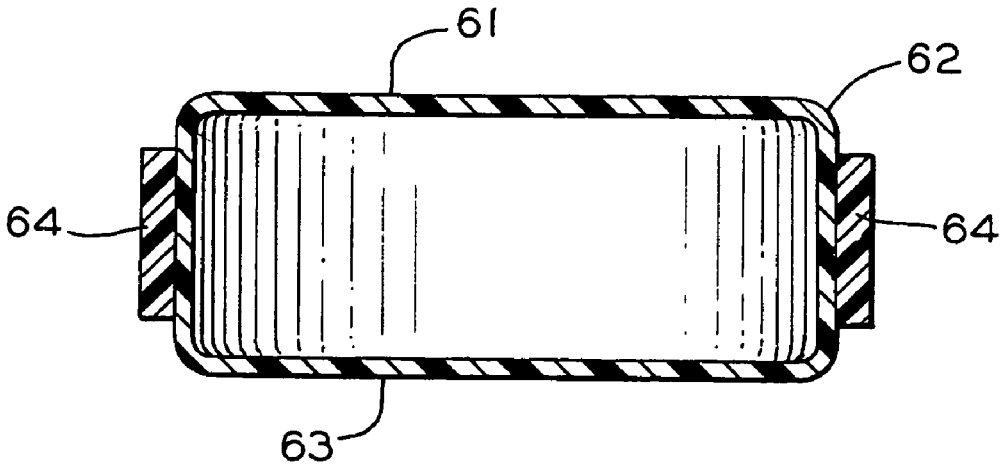
FIG. 12 is a cross sectional view of the hockey puck shown in FIG. 11.
Figure 13:
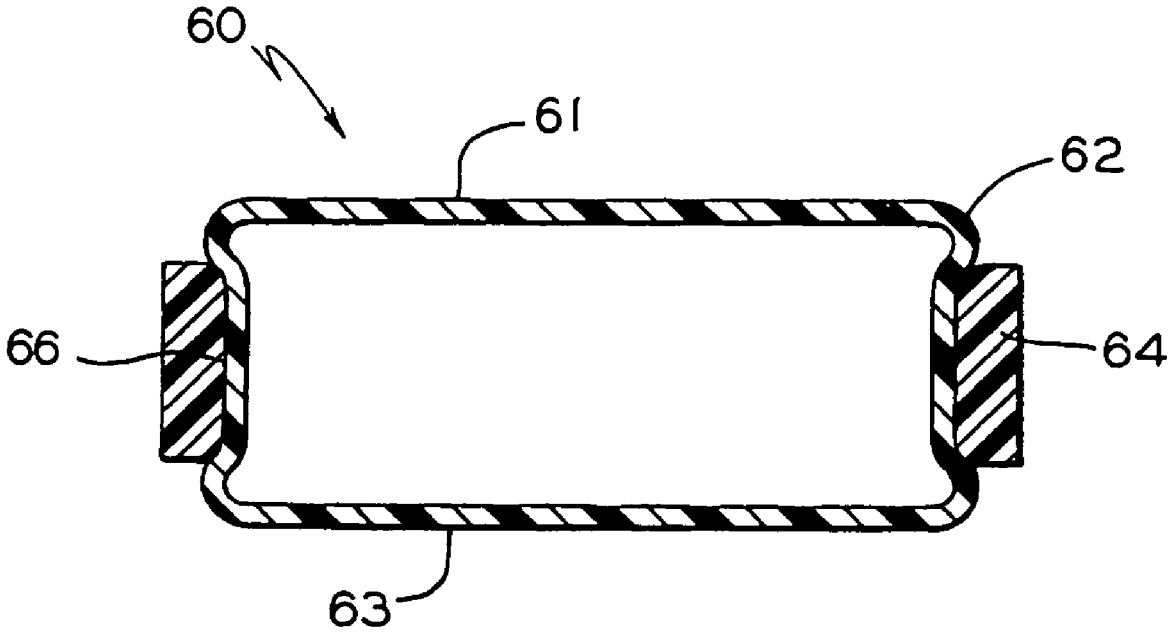
FIG. 13 is a cross sectional view of the hockey puck shown in FIG. 11 according to an alternate embodiment.

Illustrated in FIGS. 11 and 12 is yet another embodiment of the invention. In this embodiment there is provided a blow molded one piece hockey puck comprising a substantially cylindrical hollow disk like member, generally designated 60. Such disk like member 60 has each of a predetermined configuration and a predetermined thickness between a first outer sliding surface 61 and a radially opposed second outer sliding surface 63. The blow molded one piece hockey puck 60 has a substantially uniform wall thickness as is evident from the drawing Figures.

The disk like member 60 has an arcuate portion 62 between a periphery of the first outer sliding surface 61 and a sidewall 65 of the substantially cylindrical hollow disk like member 60 and between a periphery of the radially opposed second outer sliding surface 63 and the sidewall 65 of the substantially cylindrical hollow disk like member 60. The arcuate edges 62 prevent the disk like member 60 from catching or engaging the carpet surface or other imperfections on the engageable surface so as to permit the hockey puck 60 to glide freely.

In another embodiment the disk like member 60 further includes an elastomeric band 64 which engages with the side wall 65. The elastomeric band 64 covers at least a portion of the sidewall 65 and is like a sleeve that fits over the sidewall 65. The elastomeric portion is secured to the sidewall 65 by means of an adhesive or an elastic fit. In the case of the elastic fit the elastomeric portion 64 slips over the sidewall 65 similar to way a rubber band slips over an object and fits tight against such object. In an alternate embodiment of the invention the disk like member 60 has an indentation 66 in the sidewall 65 to further secure the elastomeric portion 64 against the sidewall 65 of the disk like member.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. A hockey puck comprising:

(a) a resilient material having each of a first predetermined configuration, a first predetermined thickness and a predetermined hardness;

(b) a first disk having a second predetermined configuration and a second predetermined thickness engageable with a first side of said resilient material, said first disk produced from a preselected material having a predetermined coefficient of friction;

(c) a second disk having a third predetermined configuration and a third predetermined thickness engageable with an opposed second side of said resilient material, said second disk produced from said preselected material having said predetermined coefficient of friction and wherein said resilient material extends beyond a periphery of said first disk and said second disk a predetermined distance and wherein said second predetermined thickness and said third predetermined thickness of said first disk and said second disk, respectively, each have a thickness which is at least as thick as one half of said first predetermined thickness of said resilient material; and (d) wherein said first disk is secured to said second disk by mechanical means.

2. The hockey puck, according to claim 1, wherein at least a portion of said first predetermined configuration, said second predetermined configuration and said third predetermined configuration is substantially round.

3. The hockey puck, according to claim 1, wherein said second predetermined configuration and said third predetermined configuration are substantially identical.

4. The hockey puck, according to claim 1, wherein said second predetermined thickness and said third predetermined thickness are substantially identical.

5. The hockey puck, according to claim 1, wherein said mechanical means further includes a central connecting shaft.

6. The hockey puck, according to claim 5, wherein said mechanical means further includes a female socket shaft having a central opening and centrally secured to an inside portion of one of said first disk and said second disk and a male shaft which extends outwardly from an opposite one of said first disk and said second disk for engaging said central opening of said female socket shaft.

7. The hockey puck, according to claim 6, wherein said female socket shaft and said male shaft are connected by means of a socket snap fit.

8. The hockey puck, according to claim 6, wherein said female socket shaft and said male shaft are connected by means of an adhesive.

9. The hockey puck, according to claim 1, wherein said resilient material is an elastomer.

10. The hockey puck, according to claim 1, wherein said predetermined distance is between about 0.325 and about 0.425 inches.

11. The hockey puck, according to claim 1, wherein said second and said third predetermined thickness is between about 0.265 and about 0.365 inches.

12. The hockey puck, according to claim 1, wherein said first predetermined thickness is between about 0.388 and about 0.488 inches.

* * * * *